US008007070B2

(12) United States Patent
Kaga et al.

(10) Patent No.: US 8,007,070 B2
(45) Date of Patent: Aug. 30, 2011

(54) INK-JET PRINTER AND MAINTENANCE METHOD FOR INK-JET PRINTER

(75) Inventors: Hikaru Kaga, Aisai (JP); Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 703 days.

(21) Appl. No.: 12/001,903

(22) Filed: Dec. 13, 2007

(65) Prior Publication Data

US 2008/0143764 A1 Jun. 19, 2008

(30) Foreign Application Priority Data

Dec. 15, 2006 (JP) ..... 2006-338445

(51) Int. Cl.
*B41J 2/165* (2006.01)

(52) U.S. Cl. ..... 347/23

(58) Field of Classification Search ..... 347/23
See application file for complete search history.

(56) References Cited

U.S. PATENT DOCUMENTS

| | | | | |
|---|---|---|---|---|
| 5,694,157 | A * | 12/1997 | Ahlvin | 347/24 |
| 6,293,641 | B1 | 9/2001 | Yoshimura et al. | |
| 6,561,622 | B1 | 5/2003 | Suzuki et al. | |
| 2003/0071726 | A1 * | 4/2003 | Hopper et al. | 399/61 |
| 2004/0012648 | A1 * | 1/2004 | Mizoguchi et al. | 347/19 |
| 2005/0024412 | A1 * | 2/2005 | Hudd et al. | 347/19 |

FOREIGN PATENT DOCUMENTS

| | | |
|---|---|---|
| JP | 10337881 | 12/1998 |
| JP | 2000233518 | 8/2000 |

* cited by examiner

*Primary Examiner* — Julian D Huffman
(74) *Attorney, Agent, or Firm* — Frommer Lawrence & Haug LLP

(57) ABSTRACT

Ink consumption amount is calculated based on an ink amount which is used for recording and periodic preparatory jetting in a predetermined time period after a previous discharge operation. An ink of an ink amount obtained by subtracting a consumption amount for the predetermined time, from an ink capacity of an ink supply system which supplies the ink from an ink cartridge to a recording head, is discharged by a discharge mechanism. Accordingly, it is possible to maintain a favorable state of ink by replacing periodically the ink in the ink supply system without a wasteful consumption. Moreover, when the amount of ink consumed in the predetermined time period is same as or more than the ink capacity of the ink supply system, the discharge operation is not carried out. Therefore, it is possible to suppress the consumption of ink due to the discharge operation.

15 Claims, 8 Drawing Sheets

INK-JET PRINTER AND MAINTENANCE METHOD FOR INK-JET PRINTER

CROSS-REFERENCE TO RELATED APPLICATION

The present application claims priority from Japanese Patent Application No. 2006-338445, filed on Dec. 15, 2006, the disclosure of which is incorporated herein by reference in its entirety.

BACKGROUND OF THE INVENTION

1. Field of the Invention

The present invention relates to an ink-jet printer, or an ink-jet printer as an outputting apparatus such as a facsimile, an image processing apparatus, or an image recording apparatus, and a maintenance method for the ink-jet printer.

2. Description of the Related Art

In an ink-jet printer, in which an ink is supplied to a recording head from an ink supply source such as an ink tank, and a recording is carried out by jetting the ink from the recording head, when the ink stays for a long time in an ink supply system from the ink supply source up to the recording head, a moisture of the ink inside an ink supply path is evaporated. Moreover, due to entering of air into the ink supply path, an air bubble is developed. Therefore, the ink inside the ink supply system is thickened. Consequently, it is preferable that all the ink inside the ink supply system is replaced at fixed intervals, and there is not thickened ink or air bubble etc. inside the ink supply system.

An ink-jet printer including a purge unit which discharges, at every fixed interval, a certain amount of ink from the recording head for maintaining an optimum viscosity of the ink inside the ink supply system has hitherto been known.

However, in an ink-jet printer which discharges a certain amount of ink at every fixed interval, during the fixed interval, a certain amount of ink is discharged irrespective of an amount of ink consumed for printing, and an amount of ink consumed for a recovery operation of a recording head. Therefore, ink which is not required to be replaced, in other words, an amount of ink consumed by printing, a preparatory jetting (flushing) along with the printing, or the like, is discharged wastefully. Moreover, when the ink is supplied to the recording head via a flexible tube etc., since the ink inside the tube is also required to be replaced, the amount of ink to be discharged becomes large.

Therefore, in an ink-jet printer described in Japanese Patent Application Laid-open No. 10-337881, for example, an amount of ink to be discharged at the time of a purge process is let to be an amount corresponding to the number of dots remained after subtracting the number of dots used practically in recording, from a predetermined number of dots which is set in advance for each type of ink, and a wasteful consumption of the ink is prevented.

However, in the ink-jet printer described in Japanese Patent Application Laid-open No. 10-337881, for calculating an amount of ink to be discharged, it is necessary to memorize the number of dots used at the time of actual recording, and a large memory capacity is required.

SUMMARY OF THE INVENTION

An object of the present invention is to provide an ink-jet printer which is capable of maintaining a favorable state of ink by replacing the ink at fixed intervals, without discharging wastefully the ink inside an ink supply system, and which is further capable of controlling a purge process without having a need to have a large memory capacity, and a maintenance method for the ink-jet printer.

According to a first aspect of the present invention, there is provided an ink-jet printer having a recording head which jets an ink onto a recording medium, including: an ink supply system which supplies the ink to the recording head from an ink cartridge storing the ink; a discharge mechanism which discharges the ink inside the ink supply system at a timing different from a jetting timing by which the ink is jetted onto the recording medium; a timer which measures an elapsed time elapsed after the discharge mechanism discharged the ink previously; a consumption amount calculating section which calculates an ink-consumption amount of the ink consumed after the discharge mechanism discharged the ink previously; and a discharge amount determining section which determines an ink amount of the ink which is obtained by subtracting the ink-consumption amount calculated by the consumption amount calculating section during a predetermined time period which is measured by the timer, from an ink-storing amount of the ink supply system as an ink-discharge amount in which the ink is to be discharged by the discharge mechanism from the ink supply system.

According to the first aspect of the present invention, an amount of the ink which is obtained by subtracting the ink-consumption amount of the ink calculated by the consumption amount calculating section, from the ink-storing amount inside the ink supply system, is discharged by the discharge mechanism. Therefore, it is possible to reduce an amount of ink which is discharged wastefully, as compared to a case of replacing all the ink inside the ink supply system by the discharge mechanism, at a predetermined time period.

In the ink-let printer of the present invention, the predetermined time period may be divided into a plurality of divided time periods; and at each of the divided time periods, the discharge amount determining section may determine an ink-deduction amount of the ink which is obtained by subtracting the ink-consumption amount during each of the divided time periods calculated by the consumption amount calculating section, from the ink-storing amount inside the ink supply system divided according to a length of each of the divided time periods, to be the ink-discharge amount of the ink to be discharged from the ink supply system, by the discharge mechanism; and the discharge mechanism, at each of the divided time periods, may discharge the ink in the ink-discharge amount determined by the discharge amount determining section. In this case, it is possible to replace the ink by dividing into a plurality of times. Therefore, even when a period of the discharge operation which is carried out for avoiding the blocking of nozzles in the recording head is shorter than an interval at which the ink inside the ink supply system has to be replaced, by carrying out the discharge operation divided into the plurality of times, it is possible to avoid the blocking of nozzles.

In the ink-jet printer of the present invention, when the elapsed time measured by the timer has exceeded the predetermined time period, the discharge mechanism may discharge the ink in the ink-discharge amount determined by the discharge amount determining section. In this case, it is possible to change the ink inside the ink supply system at the predetermined time period.

The ink-jet printer of the present invention may further include a discharge judging section which judges whether or not the discharge by the discharge mechanism is necessary; and when the ink-discharge amount determined by the discharge amount determining section is not more than zero, the discharge judging section may judge that the discharge is unnecessary. In this case, since the discharge operation is not executed when the amount of the ink consumed in the predetermined time period is more than the ink-storing amount inside the ink supply system, the ink is not discharged wastefully.

The ink-jet printer of the present invention may further include: a storage section which stores a predetermined ink-recording amount of the ink necessary for performing the recording per unit number of the recording medium, and a predetermined preparatory jetting amount necessary for the recording per unit number of the recording medium; and a counter which counts the number of the recording media on which recording has been performed; and the consumption amount calculating section may calculate the ink-consumption amount based on the predetermined ink-recording amount and the predetermined preparatory ink-jetting amount stored in the storage section, and based on the number of the recording media counted by the counter. In this case, the predetermined amount of ink necessary for recording per unit number of the recording medium, and the predetermined preparatory jetting amount necessary for the recording per unit number of the recording medium are stored in the storage section. Therefore, as compared to a case of storing the number of dots used practically at the time of the recording, the purpose is served by a less memory capacity.

The ink-jet printer of the present invention may further include: a carriage on which the recording head is provided, and which reciprocates in a direction orthogonal to a transporting direction of the recording medium; a storage section which stores a predetermined ink-jetting amount of the ink which is necessary for performing the recording per one reciprocation of the carriage; and a counter which counts a number of times of the reciprocation of the carriage; and the consumption amount calculating section may calculate the ink-consumption amount of the ink based on the predetermined ink-recording amount and the predetermined preparatory ink-jetting amount stored in the storage section, and the number of times of reciprocation of the carriage counted by the counter. In this case, the predetermined amount of ink which is necessary for per cycle of reciprocating of the carriage, and the predetermined preparatory jetting amount necessary for the recording per cycle of reciprocating may be stored in the storage section. Therefore, as compared to a case of storing the number of dots used practically at the time of recording, the purpose is served by a less memory capacity.

In the ink-jet printer of the present invention, the ink cartridge may be provided at an outside of the carriage provided with the recording head; and the ink supply system may include a sub tank which is provided on the carriage together with the recording head and a flexible tube which connects the sub tank and the ink cartridge.

In the ink-jet printer of the present invention, the ink may include a plurality of color inks; the consumption amount calculating section may calculate the ink-consumption amount for each of the color inks; and the discharge amount determining section may determine the ink-discharge amount for each of the color inks.

In the ink-jet printer of the present invention, the discharge mechanism may discharge the ink from inside of the ink supply system by sucking the ink from the recording head.

In the ink-jet printer of the present invention, the discharge mechanism may discharge the ink inside the ink supply system from the recording head, by pressurizing the ink inside the ink cartridge.

According to a second aspect of the present invention, there is provided an ink-jet printer having a recording head which jets an ink onto a recording medium, including: an ink cartridge which stores the ink; an ink supply system which supplies the ink from an ink cartridge to the recording head; a discharge mechanism which discharges the ink inside the ink supply system at a timing different from a jetting timing by which the ink is jetted onto the recording medium; a first counter which counts a number of the recording medium on which the recording has been performed after the discharge mechanism discharged the ink previously; a consumption amount calculating section which calculates a first ink-consumption amount of the ink by multiplying an ink-consumption amount in which the ink is anticipated to be consumed for performing recording per unit number of the recording media, by the number of the recording media counted by the first counter; and a discharge amount determining section which determines an ink-discharge amount of the ink to be discharged by the discharge mechanism by subtracting the first ink-consumption amount of the ink from an ink-storing amount inside the ink supply system.

According to the second aspect of the present invention, the amount of ink which is obtained by subtracting, from the ink-storing amount inside the supply system, first ink-consumption amount of the ink which is necessary for recording of the recording medium is discharged by the discharge mechanism after the previous discharge operation. Consequently, by replacing the ink inside the ink supply system while avoiding the wasteful consumption of ink, it is possible to maintain an optimum viscosity condition of the ink.

The ink-jet printer of the present invention may further include: a timer which measures an elapsed time elapsed after the discharge mechanism discharged the ink previously; and a discharge judging section which judges whether or not the elapsed time measured by the timer is not less than a predetermined time; and only when the discharge judging section judges that the elapsed time measured by the timer is not less than the predetermined time, the discharge mechanism may discharge the ink in the ink-discharge amount determined by the discharge amount determining section. When such an arrangement is made, since the discharge operation is carried out only when the elapsed time elapsed after the previous discharge operation exceeds the predetermined time period, it is possible to suppress the discharge operation to the minimum number of times necessary, upon taking into consideration the state of the ink. Consequently, it is possible to avoid the wasteful consumption of the ink, and to maintain the ink in the optimum viscosity condition.

In the ink-jet printer of the present invention, the ink-consumption amount in which the ink is anticipated to be consumed for performing the recording per the unit number of the recording media may include a preparatory ink-jetting amount in which the ink is consumed in a preparatory jetting performed before the recording is started. When such an arrangement is made, it is possible to calculate accurately the first ink-consumption amount.

The ink-jet printer of the present invention may further include a second counter which counts a number of a periodic jetting in which the ink is jetted periodically, separately from the preparatory jetting before the start of the recording; and the discharge amount determining section may determine the ink-discharging amount of the ink, by subtracting, from the ink-storing amount inside the ink supply system, a second ink-consumption amount of the ink, which is obtained by multiplying an amount of the ink consumed per periodic jetting by the number of times of periodic jetting counted by the second counter, together with the first ink-consumption amount. When such an arrangement is made, it is possible to determine the amount of ink to be discharged without further waste, upon taking into consideration the second ink-consumption amount consumed by the periodic jetting.

According to a third aspect of the present invention, there is provided ink-jet printer having a recording head which jets an ink onto a recording medium, and a carriage on which the recording head is provided and which reciprocates in a direction orthogonal to a transporting direction of the recording medium, including: an ink cartridge which stores the ink; an ink supply system which supplies the ink from the ink cartridge to the recording head; a discharge mechanism which discharges the ink inside the ink supply system at a timing different from a jetting timing by which the ink is jetted onto the recording medium; a first counter which counts a number of times for which the carriage has reciprocated after the discharge mechanism discharged the ink previously; a consumption amount calculating section which calculates; an ink-amount of the ink which is obtained by multiplying an ink-consumption amount, in which the ink is anticipated to be consumed for performing recording per one time of the reciprocation of the carriage, by the number of times of reciprocation of the carriage counted by the first counter, to be a first ink-consumption amount of the ink; and a discharge amount determining section which determines an ink-discharge amount of the ink is to be discharged by the discharge mechanism by subtracting the first ink-consumption amount of the ink from an ink-storing amount inside the ink supply system.

According to the third aspect of the present invention, it is possible to determine more accurately the actual amount of ink to be discharged, than in a case of counting the number of recording papers such as in the second aspect. Moreover, it is not necessary to increase a memory capacity.

According to a fourth aspect of the present invention, there is provided a maintenance method for ink-jet printer including an ink cartridge which stores an ink, a recording head which jets the ink onto a recording medium, and an ink supply system which supplies the ink from the ink cartridge to the recording head, the method including: discharging the ink inside the ink supply system; measuring an elapsed time elapsed after the discharging of the ink; calculating an ink-consumption amount, in which the ink has been consumed, based on a number of the recording media on which the recording has been performed after the discharging of the ink, if the measured elapsed time surpasses a predetermined time; determining an ink-discharge amount, in which the ink is to be discharged, by subtracting the ink-consumption amount from an ink-storing amount of the ink supply system; and discharging the ink in the determined ink-discharge amount, if a value of the determined ink-discharge amount is positive.

According to the fourth aspect of the present invention, the ink-discharge amount of the ink which is obtained by subtracting, from the ink storing amount inside the ink supply system, the ink-consumption amount which is calculated based on the number of recording media which are recorded after the previous discharge operation, is discharged by the discharge mechanism. Consequently, by replacing the ink inside the ink supply system while avoiding the wasteful consumption of ink, it is possible to maintain an optimum viscosity condition of the ink.

In the maintenance method for ink-jet printer of the present invention, the ink-consumption amount may be calculated based on the number of the recording media on which the recording has been performed after the discharging of the ink, and based on a predetermined ink-recording amount of the ink which is necessary for recording per unit number of the recording medium.

DETAILED DESCRIPTION OF THE PREFERRED EMBODIMENTS

An embodiment of the present invention will be described below by referring to the accompanying diagrams. This embodiment is an embodiment in which the present invention is applied to an ink-jet printer which is used for recording on a paper in a facsimile.

Figures 1A, 1B:
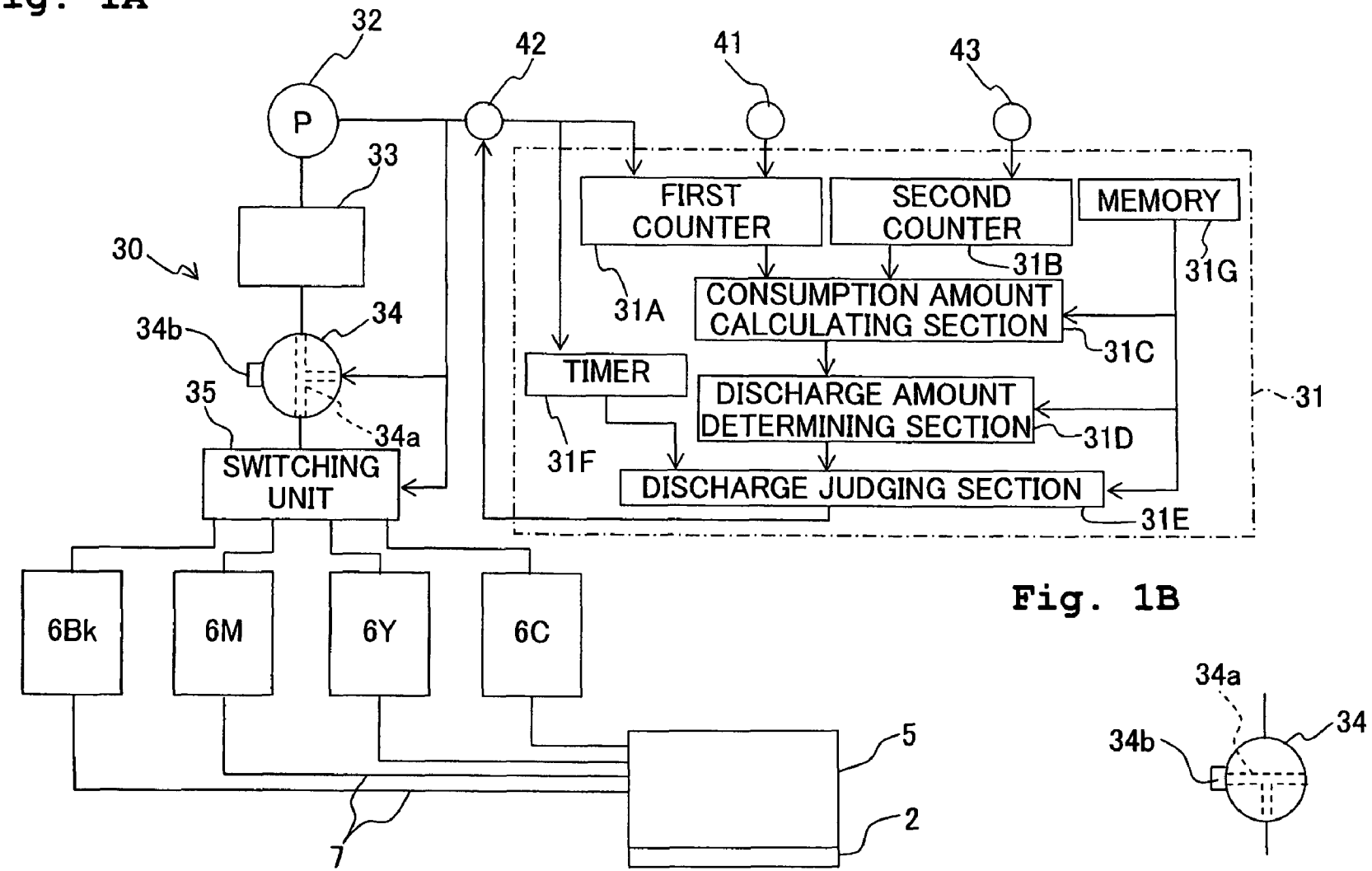
FIG. 1A is a diagram showing a schematic structure of a purge unit which discharges an ink inside an ink supply system.
FIG. 1B is a diagram showing an atmosphere-opening position of an atmosphere opening valve.

FIG. 1A is a diagram showing a schematic structure of a purge unit 30 which discharges an ink inside an ink supply system, and FIG. 1B is a diagram showing an atmosphere-opening position of an atmosphere opening valve 34.

In the ink-jet printer, the purge unit 30 (discharge mechanism) which discharges the ink inside the ink supply system includes a pressurizing pump 32 which supplies pressurized air. The pressurizing pump 32 is connected to a switching unit 35 via a surge tank 33 and an atmosphere opening valve 34 as shown in FIG. 1A. The switching unit 35 connects the pressurizing pump 32 to any one or all of ink cartridges 6Bk, 6M, 6Y, and 6C for inks of black, magenta, yellow, and cyan colors respectively. Ink from each of the ink cartridges 6Bk, 6M, 6Y, and 6C is supplied to a sub tank 5 which is partitioned according to the color, via a tube 7, and is further supplied to a nozzle group for each ink of a recording head 2. The sub tank 5 and the recording head 2 are provided on a carriage 3 (refer to FIG. 6), and the carriage 3 reciprocates in a direction orthogonal to a direction of transporting of a recording paper when the recording is performed. Each of the ink cartridges 6Bk, 6M, 6Y, and 6C, is provided in a main body of the ink-jet printer at a position outside the carriage 3. Hereinafter, the magenta ink, the yellow ink, and the cyan ink, except the black ink, are called as color inks.

The atmosphere opening valve 34 has a valve body which has an atmosphere passage 34*a* having a shape of an alphabet "T", inside a casing. By rotating the valve body, the valve 34 can be positioned at a communicating position shown in FIG. 1A and at an atmosphere opening position shown in FIG. 1B selectively. At the communicating position, the surge tank 33 communicates with an air entry port 35Aa of the switching unit (Refer to FIG. 2A and FIG. 2B) via a passage 34*a*. At the atmosphere opening position, the air entry port 35Aa of the switching unit 35 communicates with an atmosphere opening port 34*b*.

Figure 2A:
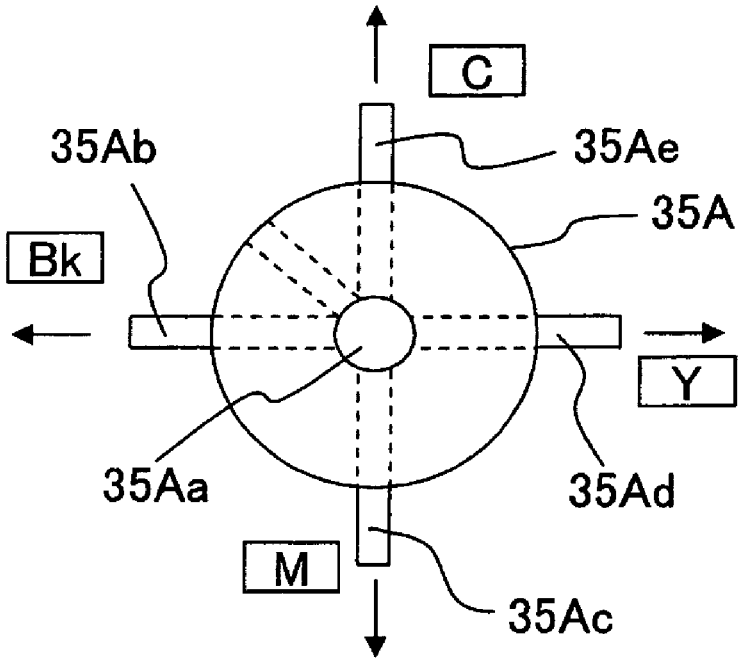
FIG. 2A and FIG. 2B are diagrams of a switching unit of the purge unit.
Figure 2B:
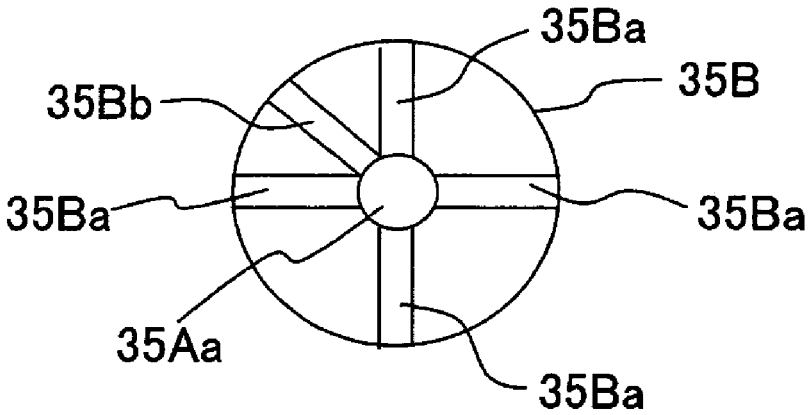

In the switching unit 35, as shown in FIG. 2A and FIG. 2B, a movable member 35B made of rubber rotates in a casing 35A, and a switching operation is performed. The movable member 35B is rotated for switching via a drive unit (not shown in the diagram) which is driven and controlled by a discharge controller 31 which will be described later.

The casing 35A, as shown in FIG. 2A, includes the ink infusing port 35Aa, through which pressurized air from the pressurizing pump 32 enters, and air discharge ports 35Ab, 35Ac, 35Ad, and 35Ae each of which communicates with an air passage to each of the ink cartridges 6Bk, 6M, 6Y, and 6C. The movable member 35B, as shown in FIG. 2B, includes four all-color pressurizing passages 35Ba, having one ends each of which communicates with the air entry port 35Aa, and the other ends each of which opens on an outer circumferential surface corresponding to one of the air discharge ports 35Ab to 35Ae. Moreover, the movable member 35B also includes one single color pressurizing passage 35Bb having one end which communicates with the air entry port 35Aa and the other end which opens on the outer circumferential surface. The all-color pressurizing passage 35Ba and the single color pressurizing passage 35Bb are provided radially to the movable member 35B, with the air entry port 35Aa as a center, in a plan view.

Figure 3A:
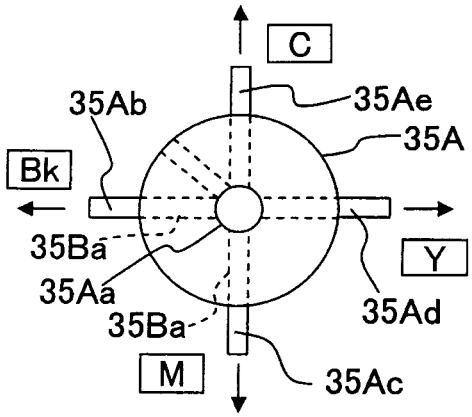
FIG. 3A, FIG. 3B, FIG. 3C, FIG. 3D, and FIG. 3E are diagrams describing an operation of the switching unit.
Figure 3B:
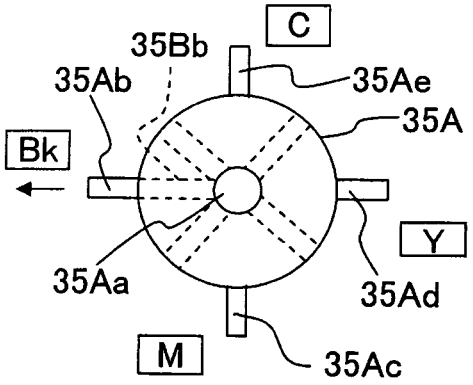
Figure 3C:
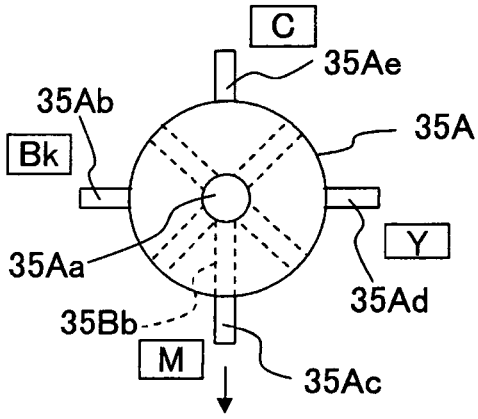
Figure 3D:
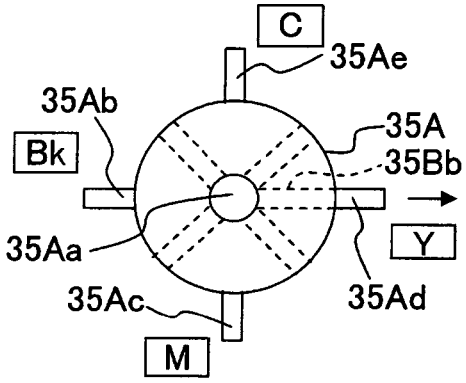
Figure 3E:
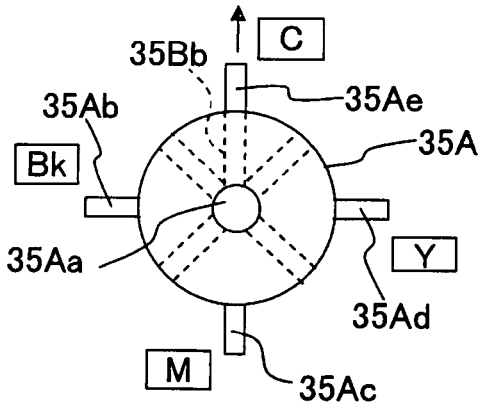

Moreover, when the inks of all colors are pressurized, as shown in FIG. 3A, the all-color pressurizing passages 35Ba are connected to the air discharge ports 35Ab, 35Ac, 35Ad, and 35Ae each of which communicates with one of the ink cartridges 6Bk, 6M, 6Y, and 6C, and the single-color pressurizing passage 35Bb is blocked by a wall surface of the casing 35A. Moreover, in a case of performing a discharge operation of the black ink as a single color ink at a different timing from a timing of recording operation (hereinafter called as "purge process") as shown in FIG. 3B, the single-color pressurizing passage 35Bb communicates with the air discharge port 35Ab which communicates with the black cartridge 6Bk, and the all-color pressurizing passages 35Ba are blocked by the wall surface of the casing 35A. In a case of performing the purge process for each of the color inks, similarly as in the case of the black ink, the single-color pressurizing passage 35Bb is alternately connected to the air discharge ports 35Ac, 35Ad, and 35Ae communicating with the magenta cartridge 6M, the yellow cartridge 6Y, and the cyan cartridge 6C respectively, and the all-color pressurizing passages 35Ba are blocked by the wall surface of the casing 35A (refer to FIG. 3C to FIG. 3E).

The purge unit 30 starts the purge process upon receiving a signal from a purge commanding section 42 in a controller (not shown in the diagram) which controls the entire ink-jet printer. The discharge controller 31 which controls a drive unit of the switching unit 35, the atmosphere opening valve 34, and the pressurizing pump 32 via the purge commanding section 42 to drive, is a microcomputer for example. As shown in FIG. 1A, the discharge controller 31 includes a first counter 31A, a second counter 31B, a consumption amount calculating section 31C, a discharge amount determining section 31D, a discharge judging section 31E, a timer 31F, and a memory 31G (storage section).

The first counter 31A counts the number m of recording papers which are fed to the recording head 7 after the previous purge process, based on a signal from a paper feeding sensor 41 which is arranged in a paper feeding path. Or, the number of change-page signals in recording data may be counted. The first counter 31A, upon receiving the signal from the purge commanding section 42, resets a count number, and starts counting again.

The second counter 31B counts the number of times n for which the jetting is carried out periodically (hereinafter called as "periodic flushing"), separately from a preparatory jetting before the start of recording. The second counter 31B counts the number of times n of the periodic flushing based on a signal from a flushing commanding section 43 in the controller which controls the entire ink-jet printer for example. The periodic flushing, as it has been known, is carried out for facilitating a recovery of a jetting function, by jetting the ink at a timing different from a jetting timing by which the ink is jetted based on the recording data from all nozzles, by moving the recording head 7 to a flushing area which is provided at one end of a range of movement of the carriage 3.

The consumption amount calculating section 31C reads the number m of recording papers stored in the first counter 31A, and an ink-consumption amount, which is anticipated to be consumed for recording per one recording paper, stored in the memory 31G which will be described later, and multiplies the anticipated ink-consumption amount by the number of recording papers m, and calculates a result to be a first ink-consumption amount. Here, the ink-consumption amount which is anticipated to be consumed for recording per one recording paper includes an ink amount c in which the ink is consumed in a preparatory jetting carried out before start of recording for each recording paper. In other words, the ink-consumption amount which is anticipated to be consumed for recording per one recording paper is a sum (b+c) of the ink amount b necessary for recording for one recording paper, and the ink amount c in which the ink is consumed in the preparatory jetting before the start of recording. The ink amount b necessary for recording for one recording paper may be calculated experimentally by practically carrying out recording on a multiple number of recording papers, or may be calculated by a so-called duty value, such as 5%, which is a proportion of the number of dots of average recording data, with respect to the number of dots corresponding to the entire recordable area.

Moreover, the consumption amount calculating section 31C reads the number of times n, for which the periodic flushing is carried out, stored in the second counter 31B, and an ink amount d, which is to be consumed per one periodic flushing, stored in the memory 31G which will be described later. The consumption amount calculating section 31C multiplies the ink amount d to be consumed per one periodic flushing by the number of times n of periodic flushing, and calculates a result to be a second ink-consumption amount.

The discharge amount determining section 31D calculates an amount which is obtained by subtracting the first ink-consumption amount $(b+c)\cdot m$ and the second ink-consumption amount $d\cdot n$, from a projected purge-discharge amount (a in a case of black ink and a1 in a case of color ink), in other words, calculates a value which is obtained by a (or a1)$-(b+c)\cdot m-d\cdot n$. A resultant value is determined to be an actual ink discharge amount H which is discharged by the purge unit 30.

Each of the projected purge-discharge amounts a and a1 is an ink capacity of each of ink supply systems formed by a tube 7 and a sub tank 8, and may be stored in the memory 31G which will be described later. Since the black ink is more consumed than the other color inks, an inner diameter of the tube 7 for the black ink is larger than an inner diameter of each of the tubes 7 for the other color inks, and a capacity of the sub tank 8 for the black ink is also larger than a capacity of each of the tanks for the other color inks, and a and a1 are related by a relationship $a>a1$. When a material of the sub tanks 8 is a material which does not allow an entry of air, and an evaporation of water content, it is possible to exclude the capacity of each of the sub tanks 8 from the projected purge-discharge amounts.

The timer 31F measures an elapsed time T elapsed after the previous purge process based on a signal from the purge commanding section 42 which commands a start of the purge process.

The discharge judging section 31E makes a judgment of whether the elapsed time T measured by the timer 31F is more than a predetermined time period A (for example 60 days), as well as makes a judgment of whether or not the ink discharge amount calculated by the discharge amount determining section 31D is positive (in other words, whether positive or less than zero). Further, the discharge judging section 31E, based on the judgment, indicates to the purge commanding section 42, whether or not the purge operation is necessary. The predetermined time period A is a period after which the ink of the ink capacity a and a1 should be replaced not to cause a problem of thickening of ink and developing of an air bubble in the ink in the ink supply system, and is determined by factors such as a surface area and a material used for the ink supply system. The predetermined time period A may also be stored in the memory 31G which will be described later.

The memory 31G may be a rewritable non-volatile storage medium, and as it has been mentioned above, values such as the ink amount b necessary for recording per one recording paper, the ink amount c which is consumed in the preparatory jetting carried out before the start of recording, the ink amount d which is consumed per one periodic flushing, the projected purge-discharge amount a and a1, and the predetermined time period A are stored in the memory 31G. The values b, c, and d may be stored according to a size of the recording paper such as a post-card size and A4 size, or may be stored according to a recording mode such as a normal mode, a photo mode, and a draft mode. The memory 31G, as it has been mentioned above, is referred to by the consumption amount calculating section 31C, the discharge amount determining section 31D, and the discharge judging section 31E.

Consequently, the discharge controller 31, when the predetermined time period A has elapsed after the previous purge process, and when the ink-discharge amount H calculated by the discharge amount determining section 31D is positive, indicates the purge process to the purge commanding section 42, and makes the purge unit 30 execute the purge process.

Figure 4A:
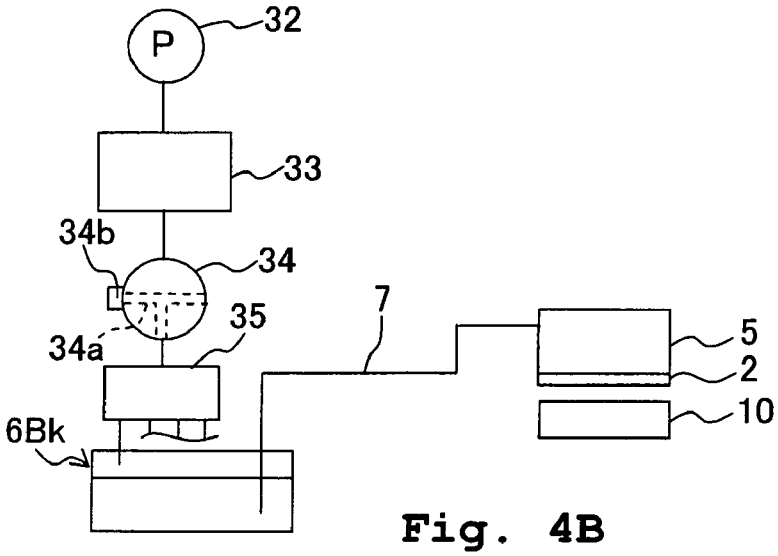
FIG. 4A, FIG. 4B, and FIG. 4C are diagrams describing a purge process.
Figure 4B:
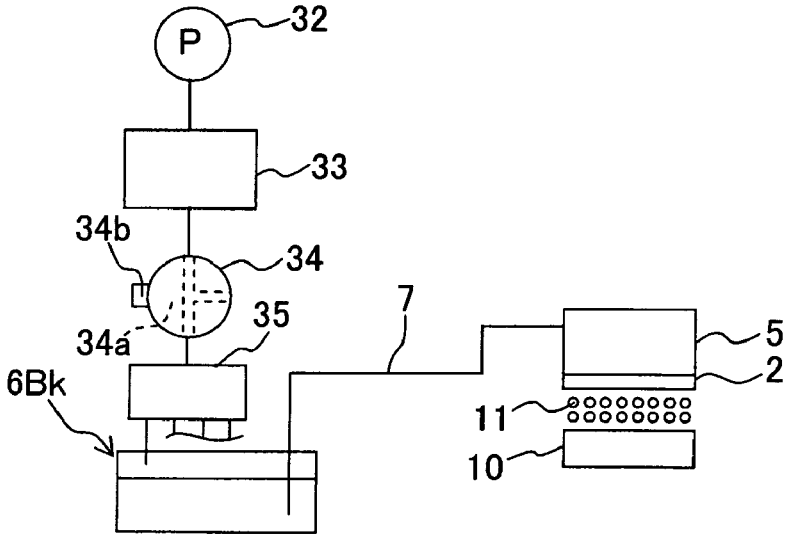
Figure 4C:
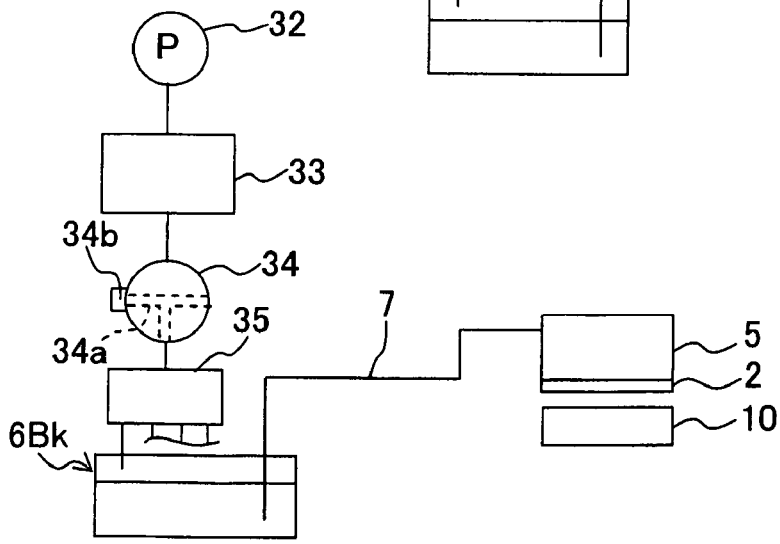

In other words, in a case of purging the black ink for example, firstly, as shown in FIG. 4A, with the atmosphere opening valve 34 blocking the surge tank 33, a pressurizing pump 32 is rotated only for the number of rotations corresponding to the ink-discharge amount H which is calculated by the discharge amount determining section 31D, and a pressure of the surge tank 33 is increased. In this case, the number of rotations of the pump 32 corresponding to the ink-discharge amount H may be stored in advance in the memory 31G of the discharge controller 31. Further, as shown in FIG. 4B, the atmosphere opening valve 34 and the switching unit 35 are switched, and a pressurized air is supplied to the ink cartridge 6Bk. The ink in the ink cartridge 6Bk is pressurized, and the ink of the ink-discharge amount H is discharged through the nozzles of the recording head 2. Thereafter, as shown in FIG. 4C, the pressurizing pump 32 is stopped, and the passage 34*a* of the atmosphere opening valve 34 communicates with the atmosphere opening port 34*b*. Accordingly, an inside of the cartridge 6Bk is opened to the atmosphere via the switching unit 35 and the atmosphere opening valve 34, and the discharge of the ink is terminated. In FIG. 4A to FIG. 4C, an ink droplet 11 which is discharged from the nozzles of the recording head 2 is absorbed in a waste-liquid foam 10.

Next, a flow of the purge process by the discharge controller 31 will be described by referring to FIG. 5.

As the process starts, firstly, the discharge judging section 31E refers to the values of the elapsed time T measured by the timer 31F, and the predetermined time period A stored in the memory 31G, and makes a judgment of whether or not the elapsed time T after the previous purge process is more than the predetermined time period A (step S1). Here, when a judgment result is negative (NO at step S1), a routine of the purge process is terminated, and the process returns to a routine of the recording operation (step S5). When the judgment result is affirmative (YES at step S1), the ink-consumption amount during the elapsed time T is calculated by the consumption amount calculating section 31C, and the discharge judging section 31E makes a judgment of whether or not the ink discharge amount H which is determined based on the in-consumption amount by the discharge amount determining section 31D is positive (step S2).

When the amount of ink (b+c)·m+d·n consumed for flushing and the recording operation after the previous purge operation is equivalent to or more than the ink capacity a (a1) of the ink supply system (NO at step S2), it means that all the ink inside the ink supply system has been replaced. In other words, since the problem of the thickening of ink or the development (growth) of the air bubble in the ink does not arise, even with the no purge process carried out, it is treated same as when the purge process has been carried out, and the elapsed time T measured by the timer, the counter 31A, and the counter 31B are reset (step S4). Next, the routine of the purge process is terminated, and the process returns to the routine of the recording operation, and the elapsed time T is measured, the number of recording papers, and the number of times of periodic flushing are counted (step S5).

When a judgment result at step S2 is affirmative (YES at step S2), it means that all the ink inside the ink supply system is not replaced, and the purge process is carried out for the black ink or the color inks for which the purge process is necessary (step S3). In this case, since an amount of ink inside the ink supply system equivalent to the ink-consumption amount (b+c)·m+d·n is replaced, when an amount of ink equivalent to a difference between the ink capacity of the ink supply system and the ink-consumption amount is discharged by purge processing, it is same as replacing all the ink inside the ink supply system. In other words, the ink-discharge amount by the purge process is calculated by the following expression. Moreover, the pressurizing pump 32 is rotated for the number of rotations corresponding to the ink-discharge amount, and the pressure of the air inside the surge tank 33 is raised higher, and the purge process is carried out by the pressurized air.

In a case of the black ink: a−(b+c)·m−d·n

In a case of the color ink: a1−(b+c)·m−d·n

Moreover, after executing the purge process, steps S4 and S5 are carried out similarly as mentioned above.

Since the purge process is carried out in such manner, it is possible to maintain an optimum viscosity (condition) of the ink with few air bubbles in the ink, and to maintain a state in which a favorable recording can be carried out. An ink-consumption amount may be obtained by storing the number of dots used for actual recordings. However, in a case of counting the number of recording papers or the frequency of periodic flushing, since count values are only to be stored, as compared to a case of storing the number of dots which are recorded, less memory capacity which is required by the discharge controller 31 serves the purpose.

It is also possible to calculate the ink-consumption amount based on the number of times of reciprocation (the number of scanning) of the carriage 3, instead of the number of recording papers. In this case, the first counter 31A may count the movement of the carriage 3 directly or the number of lines to be recorded (the number of recording lines) stored in a RAM (not shown in the diagram) which stores the recording data. In this case, an ink-consumption amount b' which is anticipated to be necessary for recording per one reciprocation of the carriage 3, and a predetermined preparatory-jetting amount c' for the recording per one reciprocation may be stored in advance in the memory 31G. It is possible to obtain the ink-consumption amount b' which is anticipated to be necessary for the recording per one reciprocation of the carriage 3 from an average duty value of recording data, in an area having a height and a length of one line. Moreover, in this case, the values b' and c' may be stored according to a size of the recording paper, or may be stored according to the recording mode.

In this embodiment, the consumption amount calculating section 31C is capable of calculating easily the first ink-consumption amount without adding the amount of ink which is consumed in the flushing which is carried out before the start of recording.

Moreover, the discharge amount determining section 31D is capable of determining the ink discharge amount without subtracting the second ink-consumption amount which is obtained by multiplying the amount of ink consumed per periodic flushing by the number of times for which the periodic flushing was carried out. In this case, since the ink-discharge amount is determined by subtracting only the first ink-consumption amount, it is possible to determine easily the ink discharge amount.

When a user has executed the purge process by performing a key operation on an operation panel for eliminating the nozzle blockage, the amount consumed by the purge operation is added to an amount of ink consumed after the previous purge process till the key operation, and based on the resultant value, the ink-discharge amount H for the subsequent periodic purge is calculated, and then steps S2, S3, S4, and S5 are executed. At this time, when the consumption amount which is added is more than the ink capacity of the ink supply system, steps S4 and S5 are executed.

Further, by dividing the predetermined time period A into a plurality of time periods, and calculating the ink consumption amount for each period, and then by carrying out the ink discharge by the purge process, it is possible to replace by dividing the ink capacity inside the ink supply system into a plurality of times.

For example, the predetermined time period (60 days) is divided into three, and each of the values in the embodiment is set to be ⅓. At step S1 in FIG. 5, the discharge judging section 31E refers to the value of the elapsed time T measured by the timer 31F, and the predetermined time period A stored in the memory 31G, and makes a judgment of whether or not the elapsed time T after the previous purge process is more than the predetermined time period A (step S1). Next, at step S2, a judgment of whether or not a value H, which is obtained by subtracting an ink consumption amount $[(b+c)\cdot m+d\cdot n]/3$ after the previous purge process, from the ink capacity a/3 (a1/3) of the ink supply system, is positive is made. When the value H is zero or negative (No at step S2), the elapsed time T measured by the timer, the counter 31A, and the counter 31B are reset (step S4). Further, the process returns to the routine of the recording operation, and the elapsed time T and the inc-consumption amount are counted from initial values.

When the value H is positive (YES at step S2), an ink discharge amount calculated by the following expression is discharged by the purge process.

In a case of black ink: $a/3-[(b+c)\cdot m+d\cdot n]/3$

In a case of color ink: $a1/3-[(b+c)\cdot m+d\cdot n]/3$

Next, after the execution of the purge process, steps S4 and S5 are executed similarly as described above.

When the abovementioned process is executed three times, all the ink inside the ink supply system is replaced in the predetermined time period (60 days). Moreover, even when a period (a cycle) of the purge process for avoiding the nozzle blockage in the recording head 2 is shorter than a period after which the ink inside the ink supply system has to be replaced, by carrying out the purge process upon dividing into a plurality of times, it is possible to avoid the nozzle blockage.

When the user has executed the purge process by performing a key operation for eliminating a recording defect, the consumed amount consumed by the purge operation is added to an ink-consumption amount consumed at a time when the purge operation has been carried out, from among the (three) times mentioned above, and based on the resultant value, the ink discharge amount for the subsequent periodic purge is calculated, and then steps S2, S3, S4, and S5 are executed.

Figure 6:
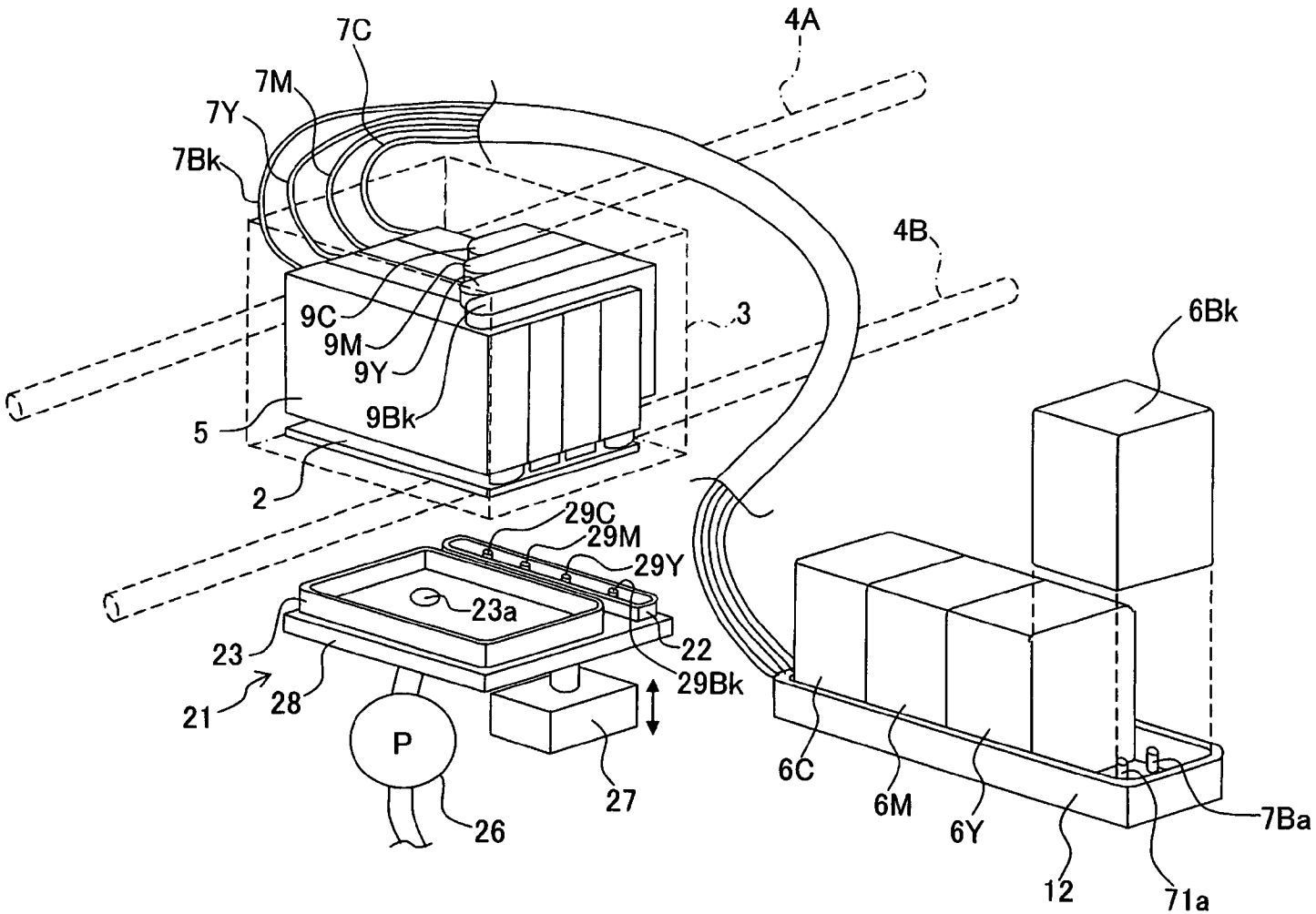
FIG. 6 is a perspective view showing a schematic structure of an ink-jet printer of another embodiment.
Figure 7:
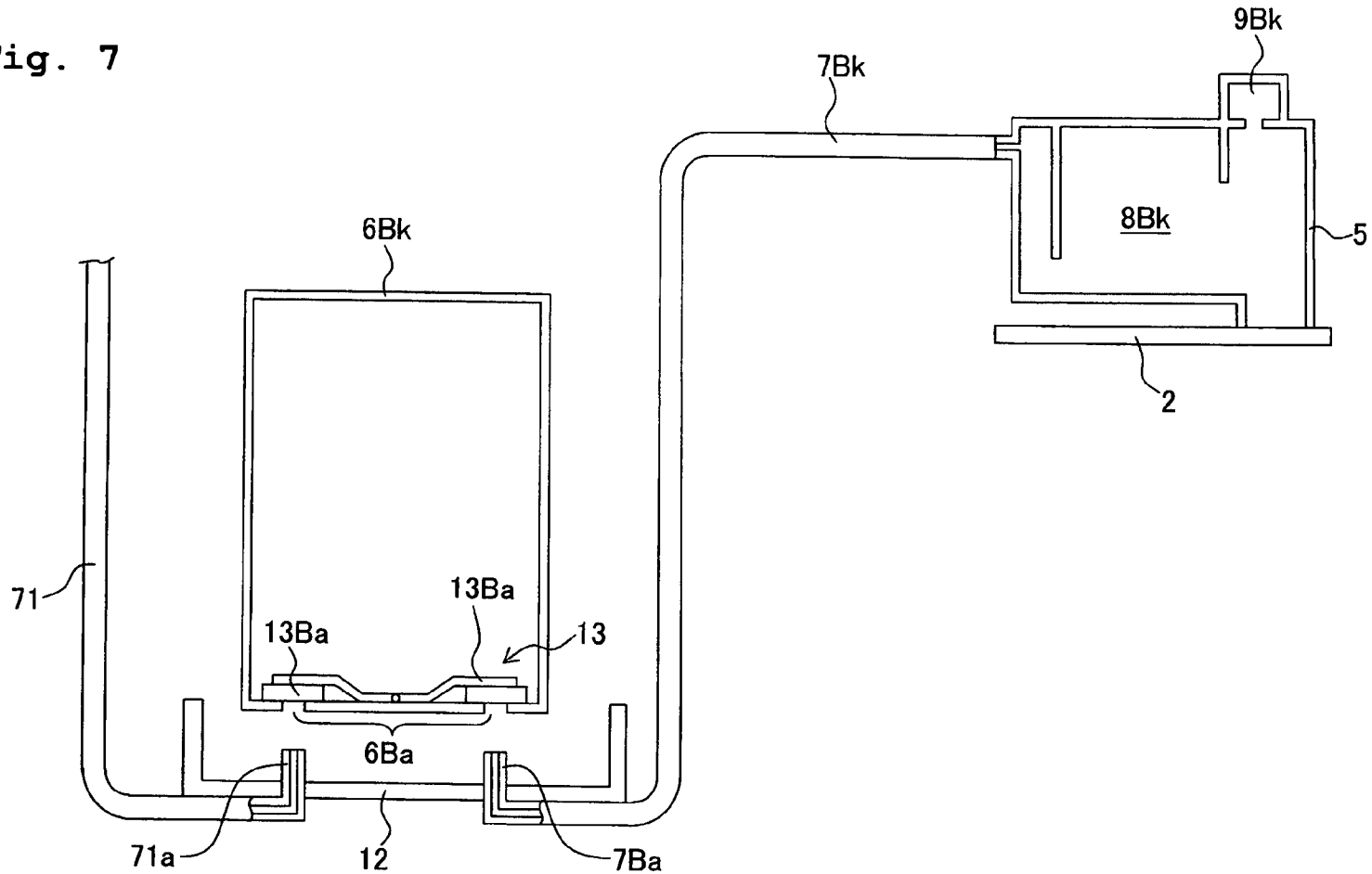
FIG. 7 is a cross-sectional view showing an ink supply path of the ink-jet printer of the another embodiment.
Figure 8:
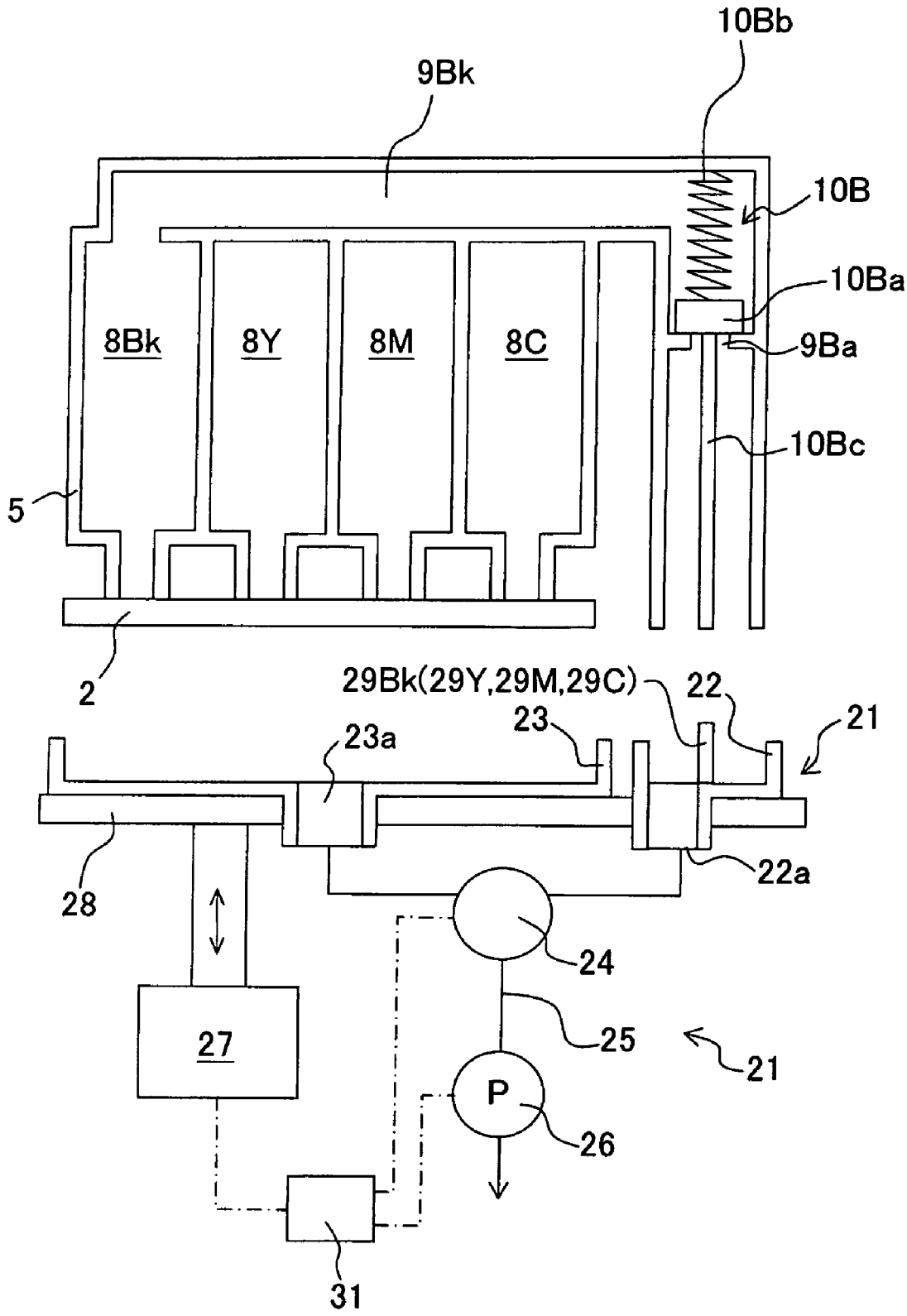
FIG. 8 is a cross-sectional view of a sub tank and a purge unit of the ink-jet printer of another embodiment.

FIG. 6 to FIG. 8 are diagrams showing the other embodiment. In the purge operation according to the embodiment described above, a method in which a positive pressure is applied to the ink, from an upstream side, and the ink is pushed out (forced out) from the nozzles of the recording head has been used. However, in this embodiment, a method in which the ink is sucked from the nozzles is used.

An ink-jet recording head 2 is provided on the carriage 3. The carriage 3 is movably supported in parallel to the recording paper, by guide shafts 4A and 4B. The sub tank 5 which supplies the ink to the recording head 2 is provided on the carriage 3.

The sub tank 5 has ink storage chambers 8Bk, 8Y, 8M, and 8C (refer to FIG. 8) which store inks of plurality of types, and air discharge passages 9Bk, 9Y, 9M, and 9C each of which communicates an upper portion space of each of the ink storage chambers 8Bk, 8Y, 8M, and 8C, with the atmosphere, for the respective inks. The inks are supplied to the ink storage chambers 8Bk to 8C from the ink cartridges 6Bk, 6Y, 6M, and 6C which are arranged at positions lower to the sub tank 5, and outside the carriage 3, through flexible tubes 7Bk, 7Y, 7M, and 7C respectively.

Regarding an upstream end of each of the tubes 7Bk to 7C, the upstream end of the ink supply tube 7Bk for the black ink as shown in FIG. 2A, is formed as a connecting portion 7Ba having a cylindrical shape. The connecting portion 7Ba is arranged to be projecting upward from a bottom portion of a cartridge tray 12. Moreover, as shown in FIG. 7, parallel to the connecting portion 7Ba, a connecting portion 71*a* of an atmosphere communicating tube 71 is arranged on the bottom portion of the cartridge tray 12. By loading the ink cartridge 6Bk on the cartridge tray 12, the connecting portions 7Ba and 71*a* are inserted into openings 6Ba and 6Ba respectively, and valves 13Ba and 13Ba are opened. Accordingly, the ink is supplied from the ink cartridge 6Bk to the ink storage chamber 8Bk through the tube 7Bk, and the atmosphere is introduced (enters) into the cartridge 6Bk from the atmosphere communicating tube 71.

Regarding the air discharge passages 9Bk to 9C, the air discharge passage 9Bk for the black ink as shown in FIG. 8, has an air discharge valve 10B which makes communicate, or cuts off the ink storage chamber 8Bk and the atmosphere. The air discharge valve 10B, as shown in FIG. 8 includes an air discharge plate 10Ba which openably blocks an air discharge port 9Ba provided near an opening end at an atmosphere side of the air discharge passage 9Bk, and a spring 10Bb which imparts a bias (force) all the time on the air discharge plate 10Ba in a direction of closing the air discharge port 9Ba. Moreover, the air discharge plate 10Ba includes a rod 10Bc which extends up to an area near the opening end at the atmosphere side of the air discharge passage 9Bk, on a surface on a side opposite to a side of making contact with the spring 10Bb. By making the rod 10Bc ascend against a spring force of the spring 10Bb with a projection 29Bk which will be described later, the air discharge port 9Ba is opened. An ink jetting nozzle of the recording head 2, and the opening end at the atmosphere side of the air discharge passages 9Bk to 9C are open almost in parallel, adjacently, on a lower surface of the carriage 3.

As shown in FIG. 6 and FIG. 8, a purge unit 21 (discharge mechanism) is provided facing a lower surface of the carriage 3, in a path of movement of the carriage 3, at a predetermined stand-by position at which the recording on the recording medium is not performed.

The purge unit 21 includes an air discharge cap 22 which is connected to be contacted to and separated apart from the opening end on the atmosphere side of the air discharge passages 9Bk to 9C, and a suction cap 23 which is connected to be contacted to and separated from the ink jetting nozzles of the recording head 2, and the air discharge cap 22 and the suction cap 23 are provided adjacently. Connecting openings 22*a* and 23*b* of the air discharge passage 22 and the suction cap 23 are connected to a suction pump 26 via a suction channel 25 having a switching valve 24. The switching valve 24 is a valve which selectively connects the air discharge cap 22 and the suction cap 23 to the suction pump 26.

The air discharge cap 22 and the suction cap 23 are provided on a movable plate which is ascendably supported by an ascending and descending unit 27. Moreover, projections 29Bk, 29Y, 29M, and 29C are provided to be projected (protruded) in a vertical direction, corresponding to a rod of each air discharge plate. By ascending movement of the air discharge cap 22, the projections 29Bk to 29C push up the rod of each air discharge plate, and the air discharge valve is opened.

The switching valve 24, the suction pump 26, and the ascending and descending unit 27 are controlled by the discharge controller 31 which is a microcomputer for example.

Generally, in a state in which the recording operation is possible, the ink in each of the ink storage chambers 8Bk to 8C of the sub tank, communicates with the ink in the ink cartridges 6Bk to 6C via the tubes 7Bk to 7C, and each air discharge plate (only the air discharge plate 10Ba is shown in the diagram) is in a state of having sealed each of the ink storage chambers 8Bk to 8C. Since an opening surface of the ink jetting nozzles of the recording head 2 is positioned at an upper side in a direction of gravity, of the ink cartridges 6Bk to 6C, the ink inside each of the ink storage chambers 8Bk to 8C is in a negatively pressurized state due to a water head difference of the ink inside the ink cartridges 6Bk to 6C. In this state, due to the operation of the recording head 2 as it has been known, the ink is jetted as a (liquid) droplet.

During the recording operation, when air enters into the ink through walls of the tubes 7Bk to 7C, the air floats as air bubbles and is split inside the ink storage chambers 8Bk to 8C. In a case of removing the air bubbles accumulated inside the ink storage chambers 8Bk to 8C, the discharge controller 31, firstly, moves the carriage 3 to a position facing the purge unit 21. Further, the air discharge cap 22 and the suction cap 23 are ascended by driving the ascending and descending unit 27, and the opening end at the atmosphere side of each of the air discharge passages 9Bk to 9C, and a nozzle surface of the recording head 2 are covered. At this time, the projections 29Bk to 29C push up the rod 10Bc of each air discharge plate (only the air discharge plate 10Ba is shown in the diagram), and opens each air discharge port (only the air discharge port 9Ba is shown in the diagram). The switching valve 24 is switched to a state in which the air discharge cap 22 and the suction pump 26 communicate with each other, and by driving the suction pump 26 for a certain time, it is possible to discharge the air bubbles accumulated in the ink storage chambers 8Bk to 8C, to an outside.

Moreover, in a state of the air discharge cap 22 and the suction cap 23 in a close contact with the opening end of the atmosphere side of the air discharge passages 9Bk to 9C, and the nozzle surface of the recording head 2 respectively, by switching the switching valve 24 to a state in which the suction cap 23 and the suction pump 26 communicate with each other (the communication between the air discharge cap 22 and the suction pump 26 is cut off), and driving the suction pump 26 for a certain time, it is possible to discharge the air and the thickened ink inside the recording head 2, to the outside. The ink sucked by the suction pump 26 is supplied to a waste-ink tank (not shown in the diagram) via a waste-ink tube which connects to the suction pump 26.

In the abovementioned case, it is preferable that, firstly, an operation of discharging the air bubbles inside the ink storage chambers 8Bk to 8C from the air discharge passages 9Bk to 9C respectively is carried out, and thereafter, the ink is sucked from the recording head 2 by the suction cap 23. This is for preventing the air bubbles inside the ink storage chambers 8Bk to 8C from entering into the recording head 2, due to the suction in the suction cap 23.

In this structure, the discharge controller 31, similarly as in the embodiment described above, by calculating the ink-consumption amount for the recording operation, and then subtracting the ink-consumption amount from the inc capacity (ink-storing amount) inside the ink supply system, is capable of setting the ink discharge amount H in the purge unit 21. In this case, a sum of an amount of ink which moves inside the ink supply system by an operation of sucking the air bubbles from the air discharge cap 22, and an amount of ink which moves inside the ink supply system by an operation of sucking the ink from the suction cap 23 is the ink discharge amount H. An amount to be sucked from the air discharge cap 22 and an amount to be sucked from the suction cap 23 are set appropriately according to a resistance of the channel.

Figure 5:
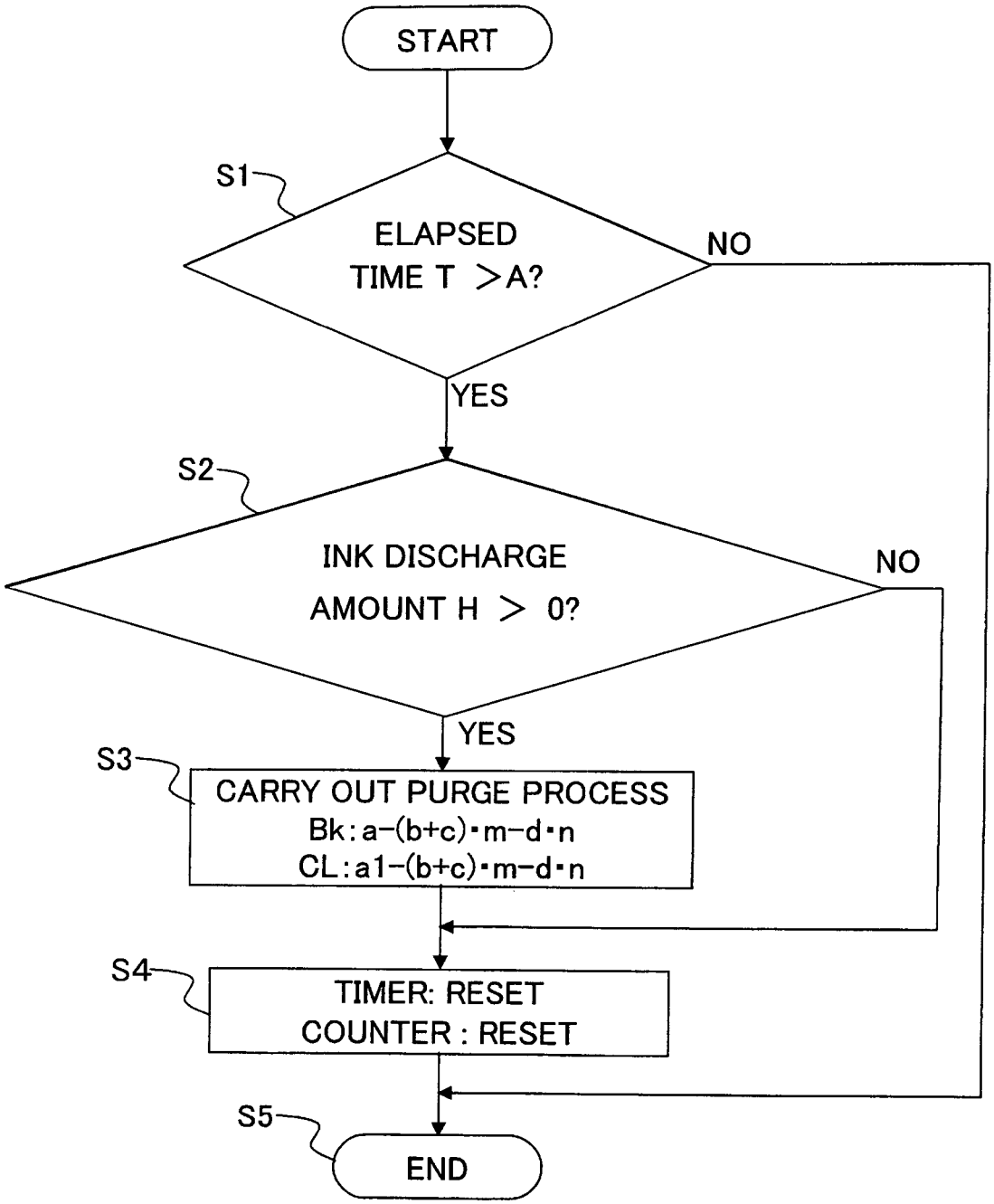
FIG. 5 is a flowchart showing a flow of the purge process.

The purge process by the discharge controller 31 is carried out according to a flowchart in FIG. 5 similarly as in the embodiment described above. Moreover, similarly, it is also possible to carry out the purge process by dividing the predetermined time period A into a plurality.

In this embodiment, although the air bubbles are discharged simultaneously from the four ink storage chambers 8Bk to 8C, and sucked simultaneously through the nozzles, in this case, the ink discharge amount H to be discharged by the purge unit 21 is to be set for an ink having the least ink-consumption amount among the four inks.

It is also possible to discharge the air bubbles and also to suck the ink, for each of the four ink storage chambers 8Bk to 8C. For example, a driving mechanism may be connected to each of the projections 29Bk to 29C, and each of the air discharge plates may be opened and closed independently. Moreover, the suction cap 23 may be divided for each nozzle group corresponding to each ink storage chambers 8Bk to 8C, and each of the partitions inside the suction cap 23 can be selectively connected to the suction pump.

In the embodiment shown in FIG. 1, it is also possible to use the purge unit 21 of a suction type as in the other embodiment shown in FIG. 6 to FIG. 8. Moreover, in the other embodiment shown in FIG. 6 to FIG. 8, it is also possible to use the purge unit of a pushing type. Furthermore, in the other embodiment shown in FIG. 6 to FIG. 8, it is also possible to use a pushing type for one of the air discharge from the air discharge passages 9Bk to 9C, and the discharge from the nozzle, and the suction type for the other.

The present invention, in a case of calculating the ink-consumption amount based on the number of recording papers, is also applicable to an ink-jet printer in which the recording head is not moved by the carriage as in a line printer.

Moreover, the present invention, without being restricted to an ink-jet printer having only a printer function, is also applicable to a multi-function ink-jet printer which is provided with a plurality of functions such as a facsimile function and a copy function.

What is claimed is:

1. An ink-jet printer having a recording head which jets an ink onto a recording medium, comprising:

an ink supply system which supplies the ink to the recording head from an ink cartridge storing the ink;

a discharge mechanism which discharges the ink inside the ink supply system at a timing different from a jetting timing by which the ink is jetted onto the recording medium;

a timer which measures an elapsed time elapsed after the discharge mechanism discharged the ink previously;

a consumption amount calculating section which calculates an ink-consumption amount of the ink consumed after the discharge mechanism discharged the ink previously; and a discharge amount determining section which determines an ink amount of the ink which is obtained by subtracting the ink-consumption amount calculated by the consumption amount calculating section during a predetermined time period which is measured by the timer, from an ink-storing amount of the ink supply system as an ink-discharge amount in which the ink is to be discharged by the discharge mechanism from the ink supply system;

wherein the ink cartridge is provided at an outside of a carriage provided with the recording head;

wherein the ink supply system includes a sub tank which is provided on the carriage together with the recording head and a flexible tube which connects the sub tank and the ink cartridge; and wherein, when the ink-discharge amount determined by the discharge amount determining section is more than zero, the ink-discharge amount of the ink is discharged by the discharge mechanism and the same amount of the ink as the ink-discharge amount is supplied from the ink cartridge to the ink supply system simultaneously.

2. The ink-jet printer according to claim 1;

wherein the predetermined time period is divided into a plurality of divided time periods;

wherein at each of the divided time periods, the discharge amount determining section determines an ink-deduction amount of the ink which is obtained by subtracting the ink-consumption amount during each of the divided time periods calculated by the consumption amount calculating section, from the ink-storing amount inside the ink supply system divided according to a length of each of the divided time periods, to be the ink-discharge amount of the ink to be discharged from the ink supply system, by the discharge mechanism; and wherein the discharge mechanism, at each of the divided time periods, discharges the ink in the ink-discharge amount determined by the discharge amount determining section.

3. The ink-jet printer according to claim 1;

wherein when the elapsed time measured by the timer has exceeded the predetermined time period, the discharge mechanism discharges the ink in the ink-discharge amount determined by the discharge amount determining section.

4. The ink-jet printer according to claim 3, further comprising:

a discharge judging section which judges whether or not the discharge by the discharge mechanism is necessary;

wherein when the ink-discharge amount determined by the discharge amount determining section is not more than zero, the discharge judging section judges that the discharge is unnecessary.

5. The ink-jet printer according to claim 1, further comprising:

a storage section which stores a predetermined ink-recording amount of the ink necessary for performing the recording per unit number of the recording medium, and a predetermined preparatory jetting amount necessary for the recording per unit number of the recording medium; and a counter which counts the number of the recording media on which recording has been performed;

wherein the consumption amount calculating section calculates the ink-consumption amount based on the predetermined ink-recording amount and the predetermined preparatory ink-jetting amount stored in the storage section, and based on the number of the recording media counted by the counter.

6. The ink-jet printer according to claim 1;

wherein the carriage reciprocates in a direction orthogonal to a transporting direction of the recording medium;

wherein the ink-jet printer further comprises:

a storage section which stores a predetermined ink-jetting amount of the ink which is necessary for performing the recording per one reciprocation of the carriage; and a counter which counts a number of times of the reciprocation of the carriage; and wherein the consumption amount calculating section calculates the ink-consumption amount of the ink based on the predetermined ink-recording amount and the predetermined preparatory ink-jetting amount stored in the storage section, and the number of times of reciprocation of the carriage counted by the counter.

7. The ink-jet printer according to claim 1;

wherein the ink includes a plurality of color inks; the consumption amount calculating section calculates the ink-consumption amount for each of the color inks; and the discharge amount determining section determines the ink-discharge amount for each of the color inks.

8. The ink-jet printer according to claim 1;

wherein the discharge mechanism discharges the ink from inside of the ink supply system by sucking the ink from the recording head.

9. The ink-jet printer according to claim 1;

wherein the discharge mechanism discharges the ink inside the ink supply system from the recording head, by pressurizing the ink inside the ink cartridge.

10. An ink-jet printer having a recording head which jets an ink onto a recording medium, comprising:

an ink cartridge which stores the ink;

an ink supply system which supplies the ink from an ink cartridge to the recording head;

a discharge mechanism which discharges the ink inside the ink supply system at a timing different from a jetting timing by which the ink is jetted onto the recording medium;

a first counter which counts a number of the recording medium on which the recording has been performed after the discharge mechanism discharged the ink previously;

a consumption amount calculating section which calculates a first ink-consumption amount of the ink by multiplying an ink-consumption amount in which the ink is anticipated to be consumed for performing recording per unit number of the recording media, by the number of the recording media counted by the first counter; and a discharge amount determining section which determines an ink-discharge amount of the ink to be discharged by the discharge mechanism by subtracting the first ink-consumption amount of the ink from an ink-storing amount inside the ink supply system;

wherein the ink cartridge is provided at an outside of a carriage provided with the recording head;

wherein the ink supply system includes a sub tank which is provided on the carriage together with the recording head and a flexible tube which connects the sub tank and the ink cartridge; and wherein, when the ink-discharge amount determined by the discharge amount determining section is more than zero, the ink-discharge amount of the ink is discharged by the discharge mechanism and the same amount of the ink as the ink-discharge amount is supplied from the ink cartridge to the ink supply system simultaneously.

11. The ink-jet printer according to claim 10, further comprising:

a timer which measures an elapsed time elapsed after the discharge mechanism discharged the ink previously; and a discharge judging section which judges whether or not the elapsed time measured by the timer is not less than a predetermined time;

wherein, only when the discharge judging section judges that the elapsed time measured by the timer is not less than the predetermined time, the discharge mechanism discharges the ink in the ink-discharge amount determined by the discharge amount determining section.

12. The ink-jet printer according to claim 11;

wherein the ink-consumption amount in which the ink is anticipated to be consumed for performing the recording per the unit number of the recording media includes a preparatory ink-jetting amount in which the ink is consumed in a preparatory jetting performed before the recording is started.

13. The ink-jet printer according to claim 12, further comprising:

a second counter which counts a number of a periodic jetting in which the ink is jetted periodically, separately from the preparatory jetting before the start of the recording;

wherein the discharge amount determining section determines the ink-discharging amount of the ink, by subtracting, from the ink-storing amount inside the ink supply system, a second ink-consumption amount of the ink, which is obtained by multiplying an amount of the ink consumed per periodic jetting by the number of times of periodic jetting counted by the second counter, together with the first ink-consumption amount.

14. A maintenance method for ink-jet printer including an ink cartridge which stores an ink, a recording head which jets the ink onto a recording medium, and an ink supply system which supplies the ink from the ink cartridge to the recording head, the method comprising:

discharging the ink inside the ink supply system;

measuring an elapsed time elapsed after the discharging of the ink;

calculating an ink-consumption amount, in which the ink has been consumed, based on a number of the recording media on which the recording has been performed after the discharging of the ink, if the measured elapsed time surpasses a predetermined time;

determining an ink-discharge amount, in which the ink is to be discharged, by subtracting the ink-consumption amount from an ink-storing amount of the ink supply system; and discharging the ink in the determined ink-discharge amount, if a value of the determined ink-discharge amount is positive;

wherein the ink cartridge is provided at an outside of a carriage provided with the recording head;

wherein the ink supply system includes a sub tank which is provided on the carriage together with the recording head and a flexible tube which connects the sub tank and the ink cartridge; and wherein, when the determined ink-discharge amount is more than zero, the determined ink-discharge amount of the ink is discharged and the same amount of the ink as the determined ink-discharge amount is supplied from the ink cartridge to the ink supply system simultaneously.

15. The maintenance method for ink-jet printer according to claim 14;

wherein the ink-consumption amount is calculated based on the number of the recording media on which the recording has been performed after the discharging of the ink, and based on a predetermined ink-recording amount of the ink which is necessary for recording per unit number of the recording medium.

* * * * *